US010343395B2

(12) United States Patent
Röthlein et al.

(10) Patent No.: US 10,343,395 B2
(45) Date of Patent: Jul. 9, 2019

(54) DEVICE FOR PRINTING HOLLOW BODIES

(71) Applicant: KOENIG & BAUER AG, Würzburg (DE)

(72) Inventors: Ewald Röthlein, Retzstad (DE); Thomas Schneider, Zell am Main (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 16/300,119

(22) PCT Filed: Jul. 3, 2017

(86) PCT No.: PCT/EP2017/066487
§ 371 (c)(1),
(2) Date: Nov. 9, 2018

(87) PCT Pub. No.: WO2018/015134
PCT Pub. Date: Jan. 25, 2018

(65) Prior Publication Data

US 2019/0143669 A1 May 16, 2019

(30) Foreign Application Priority Data

Jul. 20, 2016 (DE) ..... 10 2016 213 214

(51) Int. Cl.
*B41F 17/22* (2006.01)
*B41F 35/00* (2006.01)
*B41F 17/00* (2006.01)

(52) U.S. Cl.
CPC ..... *B41F 17/22* (2013.01); *B41F 17/002* (2013.01); *B41F 35/006* (2013.01); *B41P 2235/21* (2013.01); *B41P 2235/24* (2013.01)

(58) Field of Classification Search
CPC .. B41P 2235/24; B41P 2235/21; B41F 17/22; B41F 35/006; B41F 17/002; B41F 17/14
(Continued)

(56) References Cited

U.S. PATENT DOCUMENTS 3,068,785 A * 12/1962 Ahlburg ..... B41F 17/34 101/350.3
3,955,496 A 5/1976 Urban
(Continued)

FOREIGN PATENT DOCUMENTS

DE 4201377 C1 10/1993
DE 10108753 A1 9/2002
(Continued)

OTHER PUBLICATIONS

International Search Report of PCT/EP2017/066487 dated Oct. 13, 2017.

*Primary Examiner* — Jennifer E Simmons
(74) *Attorney, Agent, or Firm* — Mattingly & Malur, PC

(57) ABSTRACT

A device for printing hollow bodies includes a rubber blanket cylinder. A supply device, which guides the hollow bodies to the rubber blanket cylinder, is provided. The supply device comprises a mandrel which is rotated by a drive. One of the hollow bodies to be printed is arranged coaxially on the mandrel. An axial spacing between the mandrel and the rubber blanket cylinder can be changed as a result of an adjusting movement of the supply device. The adjusting movement of the supply device is a linear adjusting movement. The supply device is configured as a linear system which radially supplies the hollow bodies to the rubber blanket cylinder individually and one after the other. The supply device has multiple different positions, each of which places the respective hollow body to be printed, along the adjustment path of the supply device. The positions are arranged at different respective radial distances with respect to the rubber blanket cylinder.

14 Claims, 3 Drawing Sheets

(58) Field of Classification Search
USPC ..... 414/222.06; 101/39, 37
See application file for complete search history.

(56) References Cited

U.S. PATENT DOCUMENTS

| | | | | |
|---|---|---|---|---|
| 4,384,518 | A | 5/1983 | Albin | |
| 5,311,816 | A | 5/1994 | Schliessmann | |
| 5,740,727 | A * | 4/1998 | Shriven | B41F 5/24 101/38.1 |
| 5,771,798 | A | 6/1998 | Shriver | |
| 6,490,969 | B2 * | 12/2002 | Aichele | B41F 17/22 101/37 |
| 6,550,389 | B1 | 4/2003 | Goto et al. | |
| 9,796,173 | B2 | 10/2017 | Behnke et al. | |
| 2017/0197402 | A1 | 7/2017 | Behnke et al. | |

FOREIGN PATENT DOCUMENTS

| | | | |
|---|---|---|---|
| DE | 102010045255 | A1 | 3/2012 |
| EP | 2842747A1 | A1 | 3/2015 |
| WO | 2016/008702 | A1 | 1/2016 |
| WO | 2016/142614 | A1 | 9/2016 |

* cited by examiner

DEVICE FOR PRINTING HOLLOW BODIES

CROSS REFERENCE TO RELATED APPLICATIONS

This application is the U.S. National Phase, under 35 U.S.C. 371, of PCT/EP2017/066487, filed Jul. 3, 2017; published as WO 2018/015134 A1 on Jan. 25, 2018 and claiming priority to DE 10 2016 213 214.8, filed Jul. 20, 2016, the disclosures of which are expressly incorporated herein in their entireties by reference.

FIELD OF THE INVENTION

The present invention relates to a device for printing hollow bodies. The device utilizes a blanket cylinder. A feed mechanism for advancing the hollow bodies to the blanket cylinder is provided. The feed mechanism is equipped with a clamping mandrel, which mandrel is rotatably driven by a drive. One of the hollow bodies to be printed is arranged coaxially on the clamping mandrel. An axial distance between the clamping mandrel and the blanket cylinder can be varied by an adjusting movement of the feed mechanism.

BACKGROUND OF THE INVENTION

From WO 2016/008702 A1, a device for printing hollow bodies is known, comprising a plate cylinder and an inking unit for applying printing ink to the plate cylinder, wherein the inking unit includes an ink forme roller which is or at least can be thrown onto the plate cylinder, an anilox roller which is or at least can be thrown onto the ink forme roller, and a chamber doctor blade system for applying printing ink to the anilox roller.

U.S. Pat. No. 5,771,798 A discloses a can decorator in which cans to be printed are pivoted up to a printing wheel.

EP 2 842 747 A1 discloses a rotary pad printing press for printing an essentially cylindrical outer side of an object to be printed, which has a longitudinal center axis defined by the essentially cylindrical outer side, having a plate roller, a round pad having an at least partially cylindrical outer surface, a first drive unit for driving the round pad, and a printing material mount for holding the object to be printed during the printing, wherein the printing material mount is attached to an annular rotary table, wherein the object to be printed is supplied tangentially to the round pad by means of rotary movement of the rotary table.

WO 2013/142614 A1 discloses an assembly having a clamping mandrel, wherein the clamping mandrel is mounted such that it is movable perpendicular to its longitudinal axis.

U.S. Pat. No. 4,384,518 A discloses a dry offset printing device for printing cylindrical objects, comprising a plate cylinder and a blanket cylinder, wherein a feeding mechanism is provided for advancing the objects to be printed up to the blanket cylinder, wherein the feed mechanism throws each of the objects to be printed radially onto the blanket cylinder, one at a time.

DE 10 2010 045 255 A1 discloses a device for printing spherical and/or tapered rotationally symmetrical containers, having a clamping mandrel, rotatable about the container axis, for clamping the container and for pressing the container against a printing cylinder and moving synchronously along with the printing cylinder, wherein a rigid printing cylinder bears at least one element for transferring the print image, configured as radially elastic and reversibly yielding, said element comprising a radially outer surface layer for transferring the print image, as an integral component or as a separate layer, for example a printing blanket, wherein each of the elements for transferring the print image extends over only a portion of the periphery of the printing cylinder, wherein the shape of a printing mandrel for receiving and for rotating the container to be printed is adapted accordingly to a convex, concave or convex/concave container contour.

U.S. Pat. No. 6,550,389 B1 discloses a device for printing cans, comprising a plate cylinder and a blanket cylinder, wherein a can to be printed is held on a clamping mandrel and is thrown onto the blanket cylinder.

DE 42 01 377 C1 discloses a device for printing cans, wherein the cans are advanced radially up to an auxiliary carrier for transferring a printing ink.

SUMMARY OF THE INVENTION

The object of the present invention is to devise a device for printing cylindrical hollow bodies, in particular, the device being suitable for carrying out test prints under practical operating conditions.

The object is attained according to the invention by the provision of an adjusting movement of the feed mechanism is a linear adjusting movement. The feed mechanism is configured as a linear system for feeding the hollow bodies radially, one at a time in succession, to the blanket cylinder. The feed mechanism has, along its travel path, a plurality of different positions, each for the positioning of the hollow body to be printed. Each of these different positions is located at a different radial distance from the blanket cylinder.

Advantages to be achieved with the invention will be apparent from the following description.

BRIEF DESCRIPTION OF THE DRAWINGS

Exemplary embodiments of the invention are illustrated in the set of drawings and will be detailed in the following.

In the drawings.

DESCRIPTION OF THE PREFERRED EMBODIMENT

Figure 1:
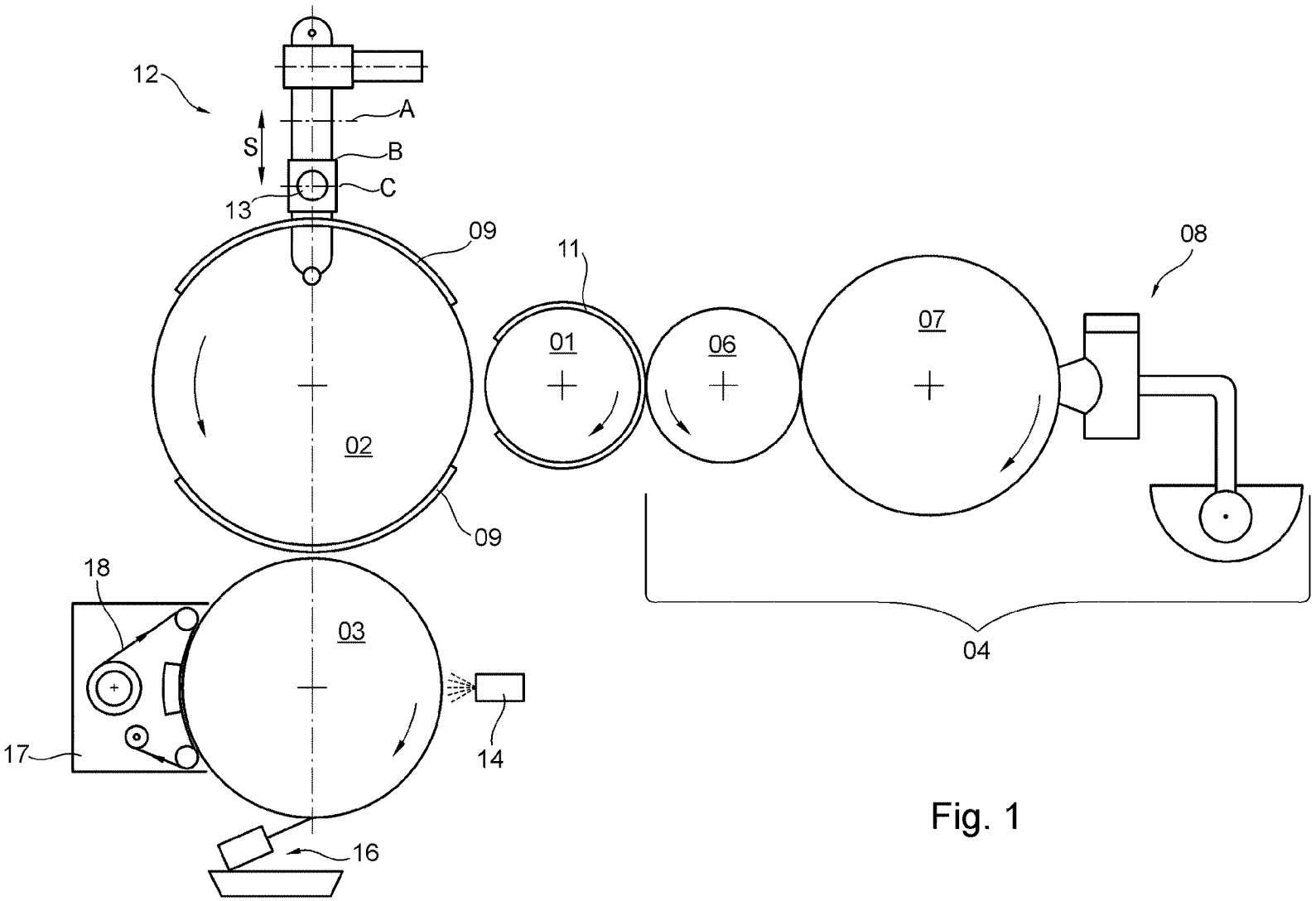
FIG. 1 shows a device for printing hollow bodies.

FIG. 1 schematically illustrates, in highly simplified form, a device for printing hollow bodies, by way of example. The hollow bodies are in particular cans, preferably cans having a can body made of aluminum or sheet steel, in particular tinplate, i.e. tin-coated sheet steel. Cans of this type form a typically cylindrical container or packaging for food and are used, e.g. as beverage cans. Beverage cans come in package sizes of 330 ml or 500 ml, for example. Beverage cans having a package size of 330 ml or 500 ml each have a diameter of typically 67 mm. The 330 ml variant typically has a height of 115 mm, while the height of the 500 ml variant is typically 168 mm. Accordingly, these hollow bodies to be printed typically have a lateral surface measuring approximately 210 mm×115 mm and approximately 210 mm×168 mm, respectively. A multicolored print motif, for example, i.e. at least one print image, is preferably applied in a production system by a letterpress printing method onto the lateral surface of said hollow bodies. Alternative printing methods include, e.g., a screen printing method or an offset printing method or a plateless digital printing method.

Because in the packaging industry hollow bodies of this type are printed in production systems in bulk quantities, e.g. of between 1,500 and 3,000 pieces per minute, it is advisable to run test prints under practical operating conditions before the release of a production run, in order, e.g. to test the flow of ink in the inking unit and/or the printability of an ink composition which has not yet been used in the production system in question and/or the quality of printing forms or printing plates and/or the suitability of printing blankets. This testing, which is aimed at optimizing the efficiency of the production process, is carried out, e.g. in a proofing machine. The proposed device for printing hollow bodies and the corresponding proposed method relate primarily to such a proofing machine. The device in question for printing hollow bodies is embodied, e.g. as a rotary printing machine.

As is clear from FIG. 1, the proposed device for printing hollow bodies comprises at least one plate cylinder 01, one blanket cylinder 02 and one impression cylinder 03, wherein the blanket cylinder 02 is or at least can be thrown onto the plate cylinder 01 and onto the impression cylinder 03. An inking unit 04 for applying printing ink to said plate cylinder 01 is provided, wherein said plate cylinder 01 transfers, or is arranged so as to transfer, at least one print image inked with printing ink to the blanket cylinder 02. In the preferred embodiment, the inking unit 04 embodied, in particular, as an anilox inking unit comprises an ink forme roller 06, which is or at least can be thrown onto said plate cylinder 01, an anilox roller 07 having saucers or a hachure, which is or at least can be thrown onto the ink forme roller 06, and a chamber doctor blade system 08 for applying printing ink to the anilox roller 07. The chamber doctor blade system 08 includes, i.a., a doctor blade chamber containing printing ink, at least one doctor blade, an ink trough and an ink pump. The ink pump delivers printing ink from the ink trough to the doctor blade chamber and holds the printing ink in the doctor blade chamber under pressure to ensure that the saucers or hachure of the anilox roller 07 are filled with ink in the most uniform manner possible. The ink pump is controlled, e.g. based upon the operating state of the anilox roller 07, with the rotational speed of the ink pump preferably being held constant, and the volume of ink delivered to the inking unit 04 being controlled based upon the temperature of the anilox roller 07. The ink pump is embodied, e.g. as an impeller pump or as a rotating positive displacement pump, preferably as an eccentric screw pump with a screw as rotor and a screw thread as stator. The ink pump preferably keeps the printing ink in the chamber doctor blade system 08 moving continuously to prevent the physical properties of the ink from changing. The contact pressure exerted by the at least one doctor blade of the chamber doctor blade system 08 on the anilox roller 07 is preferably limited and/or controlled, e.g. by at least one stop that restricts the travel path of the doctor blade. Printing ink that has been doctored off of the anilox roller 07, i.e. excess ink for the printing process, is preferably returned to the chamber doctor blade system 08. The lateral surface of the anilox roller 07 is preferably temperature controlled and is held constant by a temperature control device within a temperature range of, e.g. 20° C. to 40° C., in particular for a constant delivery of ink to inking unit 04.

Ink forme roller 06 and anilox roller 07 each have their own drive for their respective rotation. Plate cylinder 01, blanket cylinder 02 and impression cylinder 03 likewise each have their own drive for their respective rotation. The drives are each embodied, e.g. as electric motors, in particular as speed-controlled and/or position-controlled motors, e.g. each as a servomotor. The preferred direction of rotation of plate cylinder 01, blanket cylinder 02, impression cylinder 03, ink forme roller 06 and anilox roller 07 is indicated for each by a rotational direction arrow in FIG. 1. The rotational speeds of plate cylinder 01, blanket cylinder 02, impression cylinder 03, inking roller 06 and anilox roller 07 are synchronized with one another in terms of control technology.

The diameter of blanket cylinder 02 is preferably twice as great as the diameter of plate cylinder 01. This enables a plurality of blankets 09, in particular two, to be arranged one behind the other on the periphery of the blanket cylinder 02. The blankets 09 are, e.g. glued onto the lateral surface of the blanket cylinder 02. Blanket cylinder 02 is embodied, e.g. as a steel cylinder, in particular a solid steel cylinder. A single printing forme 11 or printing plate 11, e.g. in the form of a printing plate suitable for carrying out a letterpress printing method is preferably arranged on the periphery of the plate cylinder 01. Said printing forme 11 or printing plate 11 spans the circumference of plate cylinder 01 at an angle of at least 270°, for example. Said printing forme 11 or said printing plate 11 is positioned on the lateral surface of plate cylinder 01, e.g. with the help of a plate changer, which is or at least can be moved into an operative connection with said plate cylinder 01.

Also provided is a feed mechanism 12 for advancing at least one hollow body to the blanket cylinder 02. Said feed mechanism 12 preferably includes a clamping mandrel 13, which is driven in rotation by its own dedicated drive; clamping mandrel 13 is also referred to as mandrel 13, and the relevant hollow body to be printed is or is to be arranged coaxially on said clamping mandrel 13. For its part, blanket cylinder 02 transfers the print image, which has been transferred to said blanket cylinder by the plate cylinder 01, onto the lateral surface of the hollow body which has been advanced to said blanket cylinder 02. In a prepress machine in particular, feed mechanism 12 is embodied as a linear system for feeding each of the hollow bodies, one at a time in succession, radially to blanket cylinder 02.

Feed mechanism 12 positions a hollow body to be printed, which is disposed on clamping mandrel 13, at a plurality of different positions along a travel path S, e.g. three positions A; B; C, in succession, each for a certain processing time, each of these positions A; B; C being located at a different radial distance from the blanket cylinder 02, in that the feed mechanism 12 positions its clamping mandrel 13 in the different positions A; B; C in succession. The axial distance between clamping mandrel 13 and blanket cylinder 02 can thus be varied by way of a linear adjusting movement of feed mechanism 12, controlled in particular by a control device. A first position A of feed mechanism 12, which is the farthest of the various positions A; B; C from the blanket cylinder 02, is the loading position, at which clamping mandrel 13 is preferably loaded manually with the hollow body to be printed. A second position B of feed mechanism 12, spaced a shorter distance from blanket cylinder 02, i.e. closer to blanket cylinder 02 than the first position A, is a holding position at which the hollow body to be printed, which is held by clamping mandrel 13 in particular by the application of negative pressure, i.e. by suction, is brought to a certain rotational speed about its longitudinal axis by the rotational drive of clamping mandrel 13. A third position C of feed mechanism 12, located the closest among the three different positions A; B; C to blanket cylinder 02, is a printing position, at which the rotating hollow body held by the clamping mandrel 13, i.e. in particular the lateral surface thereof, is printed by means of a blanket 09 arranged on the lateral surface of blanket cylinder 02. The third position C of feed mechanism 12, i.e. the printing position, is located, e.g. at a radial distance of less than 1 mm, in particular of less than 0.5 mm, from the surface of the relevant blanket 09 arranged on the lateral surface of blanket cylinder 02. The rotational speed to which the hollow body to be printed, which is held by the rotating clamping mandrel 13, is accelerated in the holding position of feed mechanism 12 is set, e.g. to be lower than the rotational speed at which blanket cylinder 02 is traveling, in particular at the same time. For example, the rotational speed of clamping mandrel 13 is set as five revolutions per minute slower than the rotational speed of blanket cylinder 02. After the lateral surface of the hollow body has been printed, feed mechanism 12 returns the printed hollow body to its loading position, at which the printed hollow body, once its rotation has been stopped and the vacuum pressure holding it has been switched off, is preferably removed manually from clamping mandrel 13. If desired, a printed hollow body to be removed from clamping mandrel 13 may be coated prior to its removal from clamping mandrel 13 by means of a coating device provided in the printing machine and/or may be dried by means of a drying device provided in the printing machine. The travel path S that can be traversed bidirectionally by feed mechanism 12 from its first position A via its second position B to its third position C is indicated in FIG. 1 by a double arrow. Feed mechanism 12 is moved along its travel path S in particular from its holding position to its printing position by an automated mechanism, e.g. by means of a drive which preferably is or at least can be controlled by the control device, e.g. by a pneumatic cylinder 19, e.g. by means of a control signal triggered by an operator by an input into the control device, whereas the movement from the loading position to the holding position is carried out manually rather than automatically. The hollow body to be printed, which is arranged on clamping mandrel 13, is situated at its shortest distance from blanket cylinder 02 as a result of the linear adjusting movement of feed mechanism 12, in particular controlled by the control device, only when the respective printing region of the rotating blanket cylinder 02 is facing the clamping mandrel 13. The control device is also provided, e.g. for controlling additional functions of this device for printing hollow bodies, e.g. for controlling the drives and/or pumps.

Also provided therefore is a method for printing hollow bodies, with a blanket cylinder 02 having at least one printing region and one non-printing region, and with a feed mechanism 12 for advancing one hollow body at a time on a clamping mandrel 13 up to the blanket cylinder 02, wherein the hollow body to be printed is moved by feed mechanism 12, in particular bidirectionally, along a linear travel path S directed radially toward the blanket cylinder 02, from a first position A, which is the position farthest from blanket cylinder 02, via a second position B, which is located closer than the first position A to blanket cylinder 02, to a third position C, which is the position closest to blanket cylinder 02, wherein in the first position A of feed mechanism 12, the clamping mandrel 13 is loaded with the hollow body to be printed, wherein in the second position B of feed mechanism 12, the hollow body to be printed is accelerated to a certain rotational speed by a rotation of clamping mandrel 13, and wherein in the third position C of feed mechanism 12, the rotating hollow body to be printed is or at least can be printed by means of the printing region of the rotating blanket cylinder 02, in particular by way of physical contact therewith. The hollow body to be printed is preferably held on clamping mandrel 13 by the application of negative pressure, i.e. suction air. In the preferred embodiment, the hollow body to be printed is moved by feed mechanism 12 manually from the first position A to the second position B and automatically from the second position B to the third position C.

Figure 2:
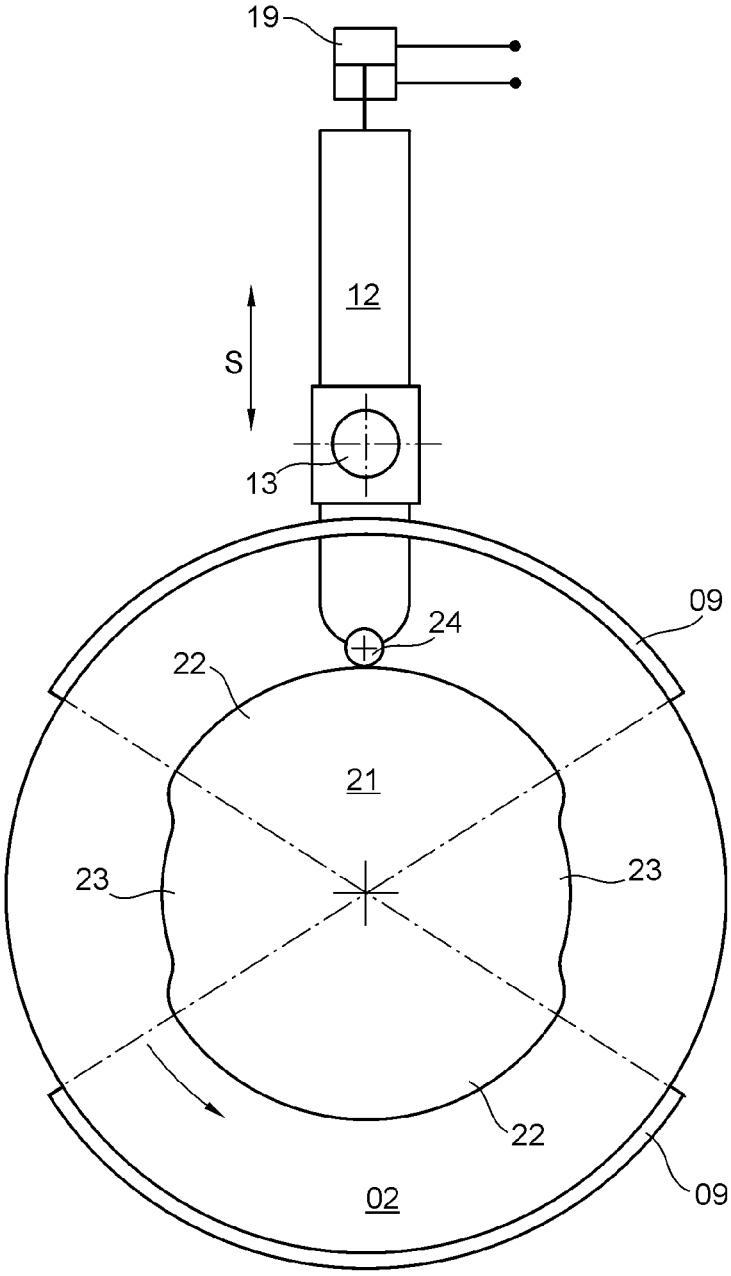
FIG. 2 shows a controller for a feed mechanism that advances a hollow body to its printing position.

At least two partial-circumference blankets 09 are preferably arranged on the lateral surface of blanket cylinder 02. In one advantageous embodiment, as shown in FIG. 2, blanket cylinder 02 is equipped with a cam disk 21, disposed coaxially at one of its end faces and having at least two curved sections 22; 23, and feed mechanism 12 is equipped with a roller 24, disposed on the side of the feed mechanism that faces blanket cylinder 02, which roller rolls or is at least capable of rolling along cam disk 21, wherein a first curved section 22 of cam disk 21 defines the printing region of blanket cylinder 02 and a second curved section 23 of cam disk 21 defines a non-printing region of blanket cylinder 02. The first curved section 22 of cam disk 21, which defines a printing region of blanket cylinder 02, and the second curved section 23 of cam disk 21, which defines a non-printing region of blanket cylinder 02, are arranged alternatingly on the periphery of cam disk 21. In the preferred embodiment, the number of first curved sections 22 on cam disk 21 is the same as the number of blankets 09 that are arranged one behind the other on the lateral surface of blanket cylinder 02. The hollow body to be printed, arranged on the mandrel 13, is located at the third position C which is closest to the blanket cylinder 02, e.g. in physical contact with the relevant blanket 09 of the rotating blanket cylinder 02, by way of the linear adjusting movement of feed mechanism 12 executed along the travel path S, only when the roller 24 of feed mechanism 12 is disposed rolling along the first curved section 22 of cam disk 21, which defines the printing region of blanket cylinder 02.

Impression cylinder 03, preferably configured as a solid body, is coated over its entire circumferential surface with a ceramic. The lateral surface of impression cylinder 03 is thereby made ink-friendly. Printing ink that is not transferred by the printing forme 11 or printing plate 11 of plate cylinder 01 to the lateral surface of the hollow body to be printed is transferred to the lateral surface of the impression cylinder 03 which is thrown onto plate cylinder 01. An applicator device 14 for applying a solvent to the lateral surface of impression cylinder 03 for the purpose of removing printing ink from the lateral surface of impression cylinder 03, a doctor blade system 16 for removing the solvent and residual printing ink from the lateral surface of impression cylinder 03, and a cleaning system 17 that includes a drying cloth 18 engaged against the lateral surface of impression cylinder 03 are or at least can be thrown in succession onto impression cylinder 03 in the direction of rotation thereof.

The applicator device 14 for applying solvent to the lateral surface of impression cylinder 03 includes, e.g. a doctor blade chamber filled with the solvent, with the solvent being circulated in the doctor chamber by means of a pump. The solvent applied from the doctor blade chamber to the lateral surface of impression cylinder 03 dissolves printing ink found on the lateral surface of impression cylinder 03 and, e.g. a doctor blade which is part of the doctor blade chamber and/or another doctor blade draw(s) the printing ink dissolved by the solvent off of the lateral surface of impression cylinder 03. In the preferred embodiment, a further doctor blade system 16 is provided, which removes the solvent and any residual printing ink that remains from the lateral surface of impression cylinder 03, this doctor blade system 16 being connected, e.g. to a suction system for suctioning the solvent and any residual printing ink that may remain off the lateral surface of impression cylinder 03.

Cleaning system 17 has, e.g. two cloth spindles and one contact pressure element, e.g. embodied as a contact pressure roller, wherein the drying cloth 18, which is or at least can be placed against the lateral surface of impression cylinder 03, is wound off of one cloth spindle and is wound onto the other cloth spindle, and the contact pressure element located in the transport path of the drying cloth 18 between the two cloth spindles is situated to press drying cloth 18 against the lateral surface of impression cylinder 03 during the cleaning process. The lateral surface of the contact pressure roller is preferably rubberized. During the cleaning process, the contact pressure element of cleaning system 17 presses drying cloth 18 against the lateral surface of impression cylinder 03 in such a way, e.g. that the pressing of the contact pressure roller against the lateral surface of impression cylinder 03 forms a roller strip having a width of, e.g. at least 2 mm, and the drying cloth 18 is or is to be guided along this roller strip opposite the direction of rotation of impression cylinder 03, with the width of the roller strip extending in the transport direction of drying cloth 18.

Figure 3:
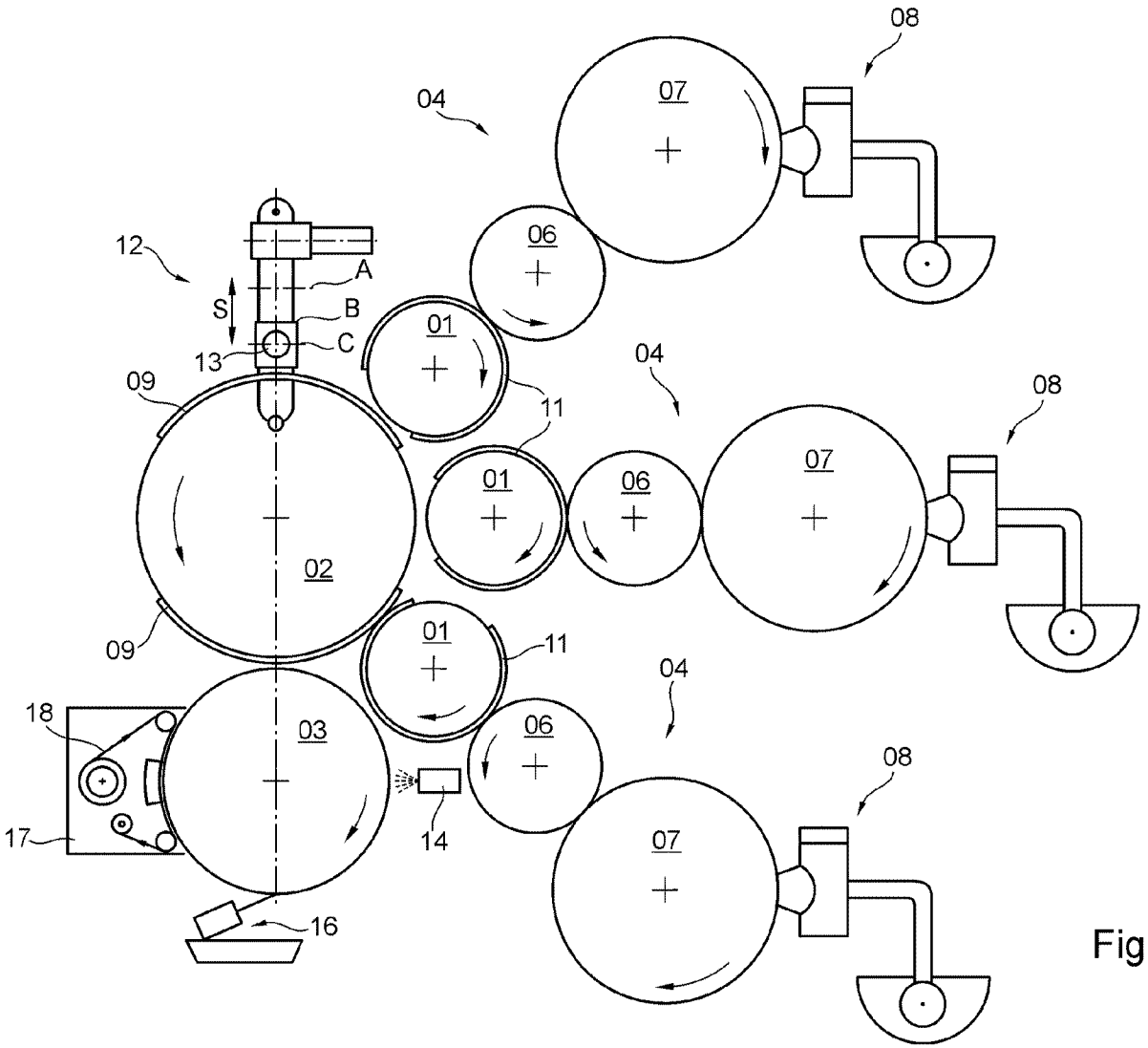
FIG. 3 shows the device of FIG. 1 for multicolor printing.

FIG. 3 shows the device depicted in FIG. 1 for printing in particular cylindrical hollow bodies, having a plurality of plate cylinders 01, e.g. three, wherein an inking unit 04, preferably of the type described, is or at least can be thrown onto each of these plate cylinders 01. Each of the plate cylinders 01 with its respective inking unit 04 preferably is or at least can be thrown in a star configuration onto blanket cylinder 02. The hollow body to be printed, as described above, is secured on mandrel 13 and is thrown onto blanket cylinder 02. On each of the plate cylinders 01, a printing plate 11 is arranged in register. This arrangement of printing plate 11 true-to-register is carried out in each case, e.g. with the help of a register system, e.g. using at least one register pin. At the inking units 04, an ink change is carried out, e.g. by replacing the chamber doctor blade system 08, in particular the ink trough, and then cleaning the inking unit 04.

While a preferred embodiment of a device for printing hollow bodies, in accordance with the present invention, has been set forth fully and completely hereinabove, it will be apparent to one of skill in the art that various changes could be made, without departing from the true spirit and scope of the present invention, which is according to the be limited only by the appended claims.

The invention claimed is:

1. A device for printing hollow bodies, comprising a blanket cylinder (02), wherein a feed mechanism (12) for advancing the hollow bodies to the blanket cylinder (02) is provided, wherein the feed mechanism (12) is equipped with a clamping mandrel (13) driven rotationally by a drive, wherein one of the hollow bodies to be printed is arranged coaxially on the clamping mandrel (13), wherein the axial distance between the clamping mandrel (13) and the blanket cylinder (02) can be varied by way of an adjusting movement of the feed mechanism (12), wherein the feed mechanism (12) is configured as a system for feeding the hollow bodies, one at a time in succession, to the blanket cylinder (02), wherein the feed mechanism (12) has along its travel path (S) a plurality of different positions (A; B; C) each for the positioning of said hollow body to be printed, wherein each of these positions (A; B; C) is located at a different radial distance from the blanket cylinder (02), characterized in that the feed mechanism (12) is configured as a linear system for feeding the hollow bodies radially to the blanket cylinder (02), wherein the adjusting movement of this feed mechanism (12) is a linear adjusting movement, wherein the blanket cylinder (02) is equipped with a cam disk (21) having at least two curved sections (22; 23), wherein the printing region of the blanket cylinder (02) is defined by a first curved section (22) of the cam disk (21) and the non-printing region of the blanket cylinder (02) is defined by a second curved section (23) of the cam disk (21).

2. The device according to claim 1, characterized in that the blanket cylinder (02) has at least one printing region and one non-printing region, one behind the other along its periphery, wherein the hollow body to be printed, arranged on the clamping mandrel (13), is located at its shortest distance from the blanket cylinder (02) only when said printing region of the rotating blanket cylinder (02) is facing the clamping mandrel (13).

3. The device according to claim 1, characterized in that the relevant hollow body to be printed is held for only a certain processing time at each of the positions (A; B; C) along the travel path (S).

4. The device according to claim 1, characterized in that the first position (A) of the feed mechanism (12), located the farthest from the blanket cylinder (02), is a loading position for loading the clamping mandrel (13) with the hollow body to be printed.

5. The device according to claim 1, characterized in that a second position (B) of the feed mechanism (12), located closer to the blanket cylinder (02) than the first position (A), is a holding position, at which the hollow body to be printed, which is held by the clamping mandrel (13), is or at least can be brought to a certain rotational speed about its longitudinal axis by the rotational drive of the clamping mandrel (13).

6. The device according to claim 1, characterized in that a third position (C) of the feed mechanism (12), which is the position closest to the blanket cylinder (02), is a printing position at which the rotating hollow body, held by the clamping mandrel (13), can be printed by means of the printing region of the rotating blanket cylinder (02).

7. The device according to claim 1, characterized in that the travel path (S) between the different positions (A; B; C) that is or at least can be traversed by the feed mechanism (12) can be configured as bidirectional.

8. The device according to claim 1, characterized in that the feed mechanism (12) has a roller (24) which rolls along the cam disk (21).

9. The device according to claim 8, characterized in that the hollow body to be printed is located at the third position (C) closest to the blanket cylinder (02) as a result of the adjusting movement of the feed mechanism (12) only when the roller (24) of the feed mechanism (12) is positioned rolling along the first curved section (22) of the cam disk (21) which defines the printing region of the blanket cylinder (02).

10. The device according to claim 1, characterized in that an impression cylinder (03) is provided, wherein the impression cylinder (03) is or at least can be thrown onto the blanket cylinder (02).

11. The device according to claim 10, characterized in that the entire circumferential surface of the impression cylinder (03) is coated with a ceramic.

12. The device according to claim 10, characterized in that an applicator device (14) for applying a solvent to the lateral surface of the impression cylinder (03) for the purpose of removing printing ink from the lateral surface of the impression cylinder (03), a doctor blade system (16) for removing the solvent and residual printing ink from the lateral surface of the impression cylinder (03), and a cleaning system (17)

having a drying cloth (18) placed against the lateral surface of the impression cylinder (03) are each arranged on the impression cylinder (03), one behind the other in the direction of rotation thereof.

13. The device according to claim 1, characterized in that the rotational speed of the clamping mandrel (13) is set as lower than the rotational speed of the blanket cylinder (02).

14. The device according to claim 1, characterized in that on the periphery of the blanket cylinder (02), a plurality of blankets (09) are arranged one behind the other, wherein each blanket (09) forms a printing region of the blanket cylinder (02).

* * * * *